US007075440B2

(12) United States Patent
Fabian et al.

(10) Patent No.: US 7,075,440 B2
(45) Date of Patent: Jul. 11, 2006

(54) MINIATURE MAGNETOMECHANICAL MARKER FOR ELECTRONIC ARTICLE SURVEILLANCE SYSTEM

(76) Inventors: Carl E. Fabian, 5001 London Walk, Miami, FL (US) 33138; Philip M. Anderson, III, 37 Winding Way, Madison, NJ (US) 07940; Gordon E. Fish, 103 Lorraine Ave., Upper Montclair, NJ (US) 07043

( * ) Notice: Subject to any disclaimer, the term of this patent is extended or adjusted under 35 U.S.C. 154(b) by 0 days.

(21) Appl. No.: 10/788,018

(22) Filed: Feb. 26, 2004

(65) Prior Publication Data

US 2004/0207528 A1 Oct. 21, 2004

Related U.S. Application Data

(60) Provisional application No. 60/451,069, filed on Feb. 27, 2003.

(51) Int. Cl.
*G08B 13/14* (2006.01)

(52) U.S. Cl. ..... 340/572.6; 340/572.1; 340/572.2; 340/572.5; 340/551; 340/552

(58) Field of Classification Search ..... 340/551, 340/552, 572.1, 572.2, 572.5
See application file for complete search history.

(56) References Cited

U.S. PATENT DOCUMENTS

| | | | | |
|---|---|---|---|---|
| 2,740,405 | A | 5/1956 | Riordan | 128/296 |
| 3,422,816 | A | 1/1969 | Robinson et al. | 128/296 |
| 3,587,583 | A | 6/1971 | Greenberg | 128/296 |
| 4,114,601 | A | 9/1978 | Abels | 128/1 R |
| 4,510,489 | A | 4/1985 | Anderson et al. | 340/572 |
| 4,510,490 | A * | 4/1985 | Anderson et al. | 340/572.1 |
| 5,057,095 | A | 10/1991 | Fabian et al. | 604/362 |
| 5,105,829 | A | 4/1992 | Fabian et al. | 128/899 |
| 5,107,862 | A | 4/1992 | Fabian et al. | 128/899 |
| 5,188,126 | A | 2/1993 | Fabian et al. | 128/899 |
| 5,190,059 | A | 3/1993 | Fabian et al. | 128/899 |
| 5,329,944 | A | 7/1994 | Fabian et al. | 128/899 |
| 5,495,230 | A * | 2/1996 | Lian | 340/572.1 |
| 5,664,582 | A | 9/1997 | Szymaitis | 128/898 |
| 5,786,762 | A * | 7/1998 | Liu | 340/551 |
| 6,130,612 | A * | 10/2000 | Castellano et al. | 340/572.6 |
| 6,404,340 | B1 * | 6/2002 | Paradiso et al. | 340/572.5 |

* cited by examiner

*Primary Examiner*—Julie Bichngoc Lieu
(74) *Attorney, Agent, or Firm*—Ernest D. Buff & Associates,LLC; Ernest D. Buff; Gordon E. Fish

(57) ABSTRACT

A miniature magnetic article surveillance system marker is adapted, when armed, to resonate at a frequency provided by an incident magnetic field applied within an interrogation zone. The marker comprises a magnetomechanical element having at least one elongated ductile strip of magnetostrictive ferromagnetic material disposed adjacent to a ferromagnetic element which, upon being magnetized, magnetically biases the strip and arms it to resonate at said frequency. A substantial change in effective magnetic permeability of the marker at the resonant frequency provides the marker with signal identity.

24 Claims, 4 Drawing Sheets

MINIATURE MAGNETOMECHANICAL MARKER FOR ELECTRONIC ARTICLE SURVEILLANCE SYSTEM

This application claims the filing date of U.S. Provisional Application No. 60/451,069, filed Feb. 27, 2003, entitled Miniature Magnetomechanical Marker For Electronic Article Surveillance System.

BACKGROUND OF THE INVENTION

1. Field of the Invention

The present invention relates to an electronic article surveillance system and a marker for use therein; and more particularly, to a system comprising a miniature magnetomechanically resonant marker that enhances the sensitivity and reliability of the article surveillance system.

2. Description of the Prior Art

Attempts to protect articles of merchandise and the like against theft from retail stores have resulted in numerous technical arrangements. Among these, a tag or marker is secured to an article to be protected. The marker responds to an interrogation signal from transmitting apparatus situated proximate either an exit door of the premises to be protected, or an aisleway adjacent to the cashier or checkout station. A nearby receiving apparatus receives a signal produced by the marker in response to the interrogation signal. The presence of the response signal indicates that the marker has not been removed or deactivated by the cashier, and that the article bearing it may not have been paid for or properly checked out.

Several different types of markers have been disclosed in the literature, and are in use. In one type, the functional portion of the marker consists of either an antenna and diode or an antenna and capacitors forming a resonant circuit. When placed in an electromagnetic field transmitted by the interrogation apparatus, the antenna-diode marker generates harmonics of the interrogation frequency in the receiving antenna; the resonant circuit marker causes an increase in absorption of the transmitted signal so as to reduce the signal in the receiving coil. The detection of the harmonic or signal level change indicates the presence of the marker. With this type of system, the marker must be removed from the merchandise by the cashier. Failure to do so indicates that the merchandise has not been properly accounted for by the cashier. In addition, markers of these types typically are relatively expensive, making it economically desirable to reuse them.

A second type of marker consists of a first elongated element of high magnetic permeability ferromagnetic material disposed adjacent to at least a second element of ferromagnetic material having higher coercivity than the first element. When subjected to an interrogation frequency of electromagnetic radiation, the marker causes harmonics of the interrogation frequency to be developed in the receiving coil. The detection of such harmonics indicates the presence of the marker. Deactivation of the marker is accomplished by changing the state of magnetization of the second element. Thus, when the marker is exposed to a dc magnetic field, the state of magnetization in the second element changes and, depending upon the design of the marker being used, either the amplitude of the harmonics chosen for detection is significantly reduced, or the amplitude of the even numbered harmonics is significantly changed. Either of these changes can be readily detected in the receiving coil.

Ferromagnetic, harmonic-generating markers are smaller, contain fewer components and materials, and are easier to fabricate than resonant-circuit or antenna-diode markers. As a consequence, such a marker can be treated as a disposable item affixed to the article to be protected and subsequently disposed of by the customer. Such markers may be readily deactivated by the application of a dc magnetic field pulse triggered by the cashier. Hence, handling costs associated with the physical removal requirements of resonant-circuit and antenna-diode markers are avoided.

One of the problems with harmonic-generating ferromagnetic markers is the difficulty of detecting the marker signal at remote distances. The amplitude of the harmonics developed in the receiving antenna is much smaller than the amplitude of the interrogation signal, with the result that the range of detection of such markers is generally limited to aisle widths less than about three feet. Another problem with harmonic-generating ferromagnetic markers is the difficulty of distinguishing the marker signal from pseudo signals generated by nearby ferrous objects, including both items ordinarily found in the retail environment such as building structures, shopping carts, and display racks, and items routinely carried by shoppers, such as belt buckles, pens, hair clips, and the like. The merchant's fear of embarrassment and adverse legal consequences associated with false alarms triggered by such pseudo signals will be readily appreciated. Yet another problem with such ferromagnetic markers is their tendency to be deactivated or reactivated by conditions other than those imposed by components of the system. Thus, ferromagnetic markers can be deactivated purposely upon juxtaposition of a permanent magnet or reactivated inadvertently by magnetization loss in the second ferromagnetic element thereof. For these reasons, article surveillance systems have resulted in higher operating costs and lower detection sensitivity and operating reliability than are considered to be desirable.

Another type of marker is disclosed by U.S. Pat. No. 4,510,489 to Anderson et al. The marker comprises an elongated, ductile strip of magnetostrictive ferromagnetic material adapted to be magnetically biased and thereby armed to resonate mechanically at a frequency within the frequency band of the incident magnetic field. A hard ferromagnetic element, disposed adjacent to the strip of magnetostrictive material, is adapted, upon being magnetized, to arm the strip to resonate at that frequency. The strip of magnetostrictive material has a magnetomechanical coupling factor, k, greater than 0, given by the formula $k=[1-(f_r/f_a)^2]^{1/2}$, wherein $f_r$ and $f_a$ are the resonant and anti-resonant frequencies of the magnetostrictive element, respectively. In the presence of a biasing dc magnetic field the effective magnetic permeability of the marker for excitation by an applied ac electromagnetic field is strongly dependent on frequency. That is to say, the effective permeability of the marker is substantially different for excitation by an ac field having a frequency approximately equal to either the resonant or anti-resonant frequency than for excitation at other frequencies. A detecting means detects the change in coupling between the interrogating and receiving coils at the resonant and/or anti-resonant frequency, and distinguishes it from changes in coupling at other than those frequencies.

However, known resonant markers comprising magnetostrictive material and systems employing such markers, including those of the type disclosed by U.S. Pat. No. 4,510,489, have a number of characteristics that render them undesirable for certain applications. The markers are elongated and relatively large in size, especially in their longest direction. As a result, they are too large to be accommodated on some items of merchandise, including many for which protection is highly desirable because of their high value. A large marker is also relatively conspicuous when affixed externally to a merchandise item. In addition, the cost of the marker disclosed by U.S. Pat. No. 4,510,489 is necessarily governed by the size of the marker and the amount of the magnetic material that accordingly must be used.

There remains a need in the art for antipilferage systems employing markers that are small, light, and inexpensive to construct and reliably detected.

SUMMARY OF THE INVENTION

The present invention provides a miniature marker capable of producing identifying signal characteristics in the presence of a magnetic field applied thereto by components of an article surveillance system. The marker has high signal amplitude and a controllable signal signature and is not readily deactivated or reactivated by conditions other than those imposed by components of the system.

In addition, the invention provides an article surveillance system responsive to the presence within an interrogation zone of an article to which the marker is secured. The system provides for high selectivity and is characterized by a high signal-to-noise ratio. Briefly stated, the system has means for defining an interrogation zone. Means are provided for generating a magnetic field of varying frequency within the interrogation zone. A marker is secured to an article appointed for passage through the interrogation zone. The marker comprises a magnetomechanical element having at least one elongated, ductile strip of magnetostrictive ferromagnetic material adapted to be magnetically biased and thereby armed to resonate mechanically at a frequency within the frequency band of the incident magnetic field. A hard ferromagnetic element, disposed adjacent to the magnetomechanical element, is adapted, upon being magnetized, to arm the strip to resonate at that frequency.

Upon exposure to the dc magnetic field, the marker is characterized by a substantial change in its effective magnetic permeability as the applied ac field sweeps through at least one of the resonant and anti-resonant frequencies that provide the marker with signal identity. A detecting means detects the change in coupling between the interrogating and receiving coils at the resonant and/or anti-resonant frequency, and distinguishes it from changes in coupling at other than those frequencies.

In one aspect of the invention there is provided a marker adapted for use in an electronic article surveillance (EAS) system that exhibits mechanical resonance at a resonant frequency in response to the incidence thereon of an alternating electromagnetic interrogating field, whereby the marker is provided with a signal-identifying characteristic. Preferably, the resonant frequency ranges from about 70 to 300 kHz. The system further comprises an interrogating means for generating an electromagnetic interrogating field having a preselected interrogating frequency, preferably modulated as a series of pulses; a detecting means for detecting the signal-identifying characteristic; and an indication means activated by the detecting means in response to the detection of the signal-identifying characteristic, which is preferably a ring-down of the electromagnetic dipole field emanating from the resonant marker. The marker preferably comprises: (i) a magnetomechanical element, preferably having one or more elongated strips of amorphous metal alloy; (ii) a bias means, preferably a bias magnet disposed within the marker, that applies a biasing magnetic field to the magnetomechanical element, whereby the marker is armed for resonance; and (iii) a housing enclosing the magnetomechanical element and the bias means, wherein the magnetomechanical element is free to mechanically vibrate at its mechanical resonant frequency. The housing preferably comprises one or more means for attaching the marker to an item appointed for detection. It is further preferred that the marker comprise a plurality of elongated strips, increasing the signal generated during resonance and/or providing the marker with sensitivity to excitation by interrogating fields directed in a plurality of orientations relative to the marker.

Various advantages attend one or more embodiments of the present invention. By virtue of the increase in resonant operating frequency from that of conventional magnetomechanically resonant tags, the present invention affords smaller, more compact markers that are attachable to a larger range of items. The increased frequency also reduces or eliminates the possibility of false alarms and missed item detection. Detection sensitivity is enhanced and detection accuracy is increased. Certain electronic noise sources generate electromagnetic interference that must be distinguished by the detection electronics from legitimate signals produced by actual activated markers. The increase in operating frequency in the present system enhances the detection reliability.

Markers in accordance with certain aspects of the invention are sensitive to interrogating fields having a wider spread of orientation than conventional markers, making it highly unlikely that a marker of the invention passing through an interrogation zone would escape detection. In light of the aforesaid advantages, systems incorporating the markers of the invention are small, lightweight, inexpensive to construct and maintain, easy to use, and operate in an accurate, reliable manner.

BRIEF DESCRIPTION OF THE DRAWINGS

The invention will be more fully understood and further advantages will become apparent when reference is had to the following detailed description of the preferred embodiment of the invention and the accompanying drawings, in which.

DESCRIPTION OF THE PREFERRED EMBODIMENTS

The present magnetomechanical marker and article surveillance system can be fabricated in various configurations. As a consequence, the invention will be found to function with many varieties of surveillance systems. For illustrative purposes the invention is described in connection with an antipilferage system wherein articles of merchandise bearing the markers are surveyed by the system to prevent theft of the merchandise from a retail store. It will be readily appreciated that the electronic article surveillance system and marker of the invention can be employed for similar and yet diversified uses, such as the identification of articles or personnel, wherein the marker and the system exchange magnetomechanical energy so that the marker functions as (1) a personnel badge for control of access to limited areas, (2) a vehicle toll or access plate for actuation of automatic sentries associated with bridge crossings, parking facilities, industrial sites or recreational sites, (3) an identifier for checkpoint control of classified documents, warehouse packages, library books and the like, and (4) product verification. Accordingly, the invention is intended to encompass modifications of the preferred embodiment wherein the magnetomechanical resonance of a marker provides a signal-identifying characteristic that allows recognition of any object appointed, by attachment of the marker, for detection by an electronic article (EAS) system. It is further intended that invention encompass the identification by an electronic article surveillance system of a person or animal bearing the marker provided in accordance with the invention.

Figure 1:
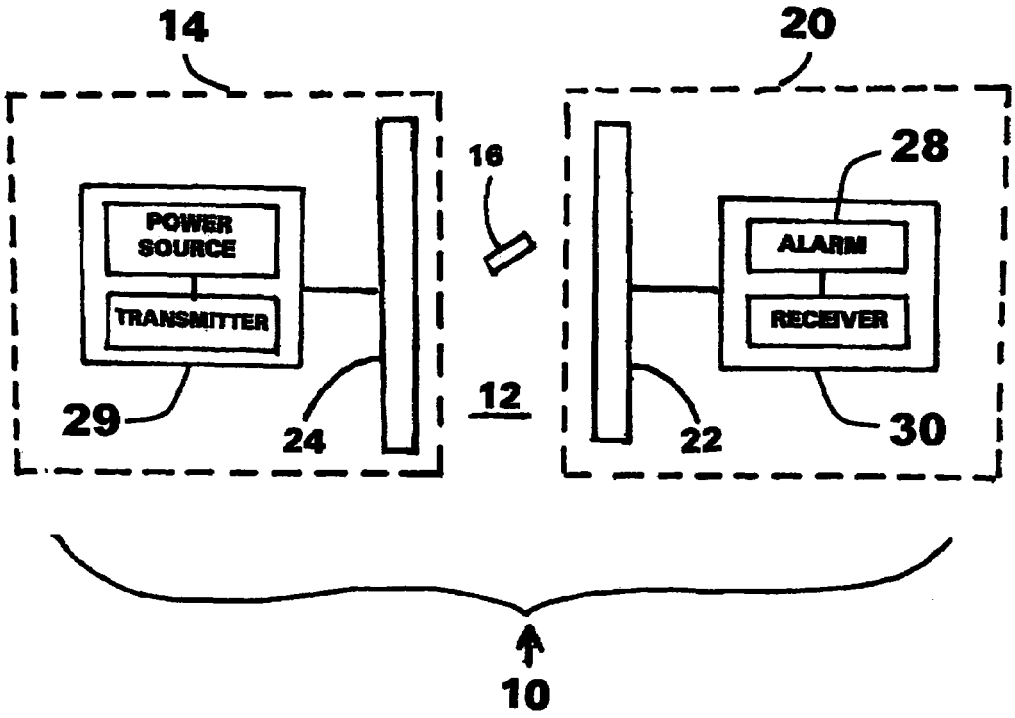
FIG. 1 is a block diagram of an article surveillance system incorporating the present invention.
Figure 2:
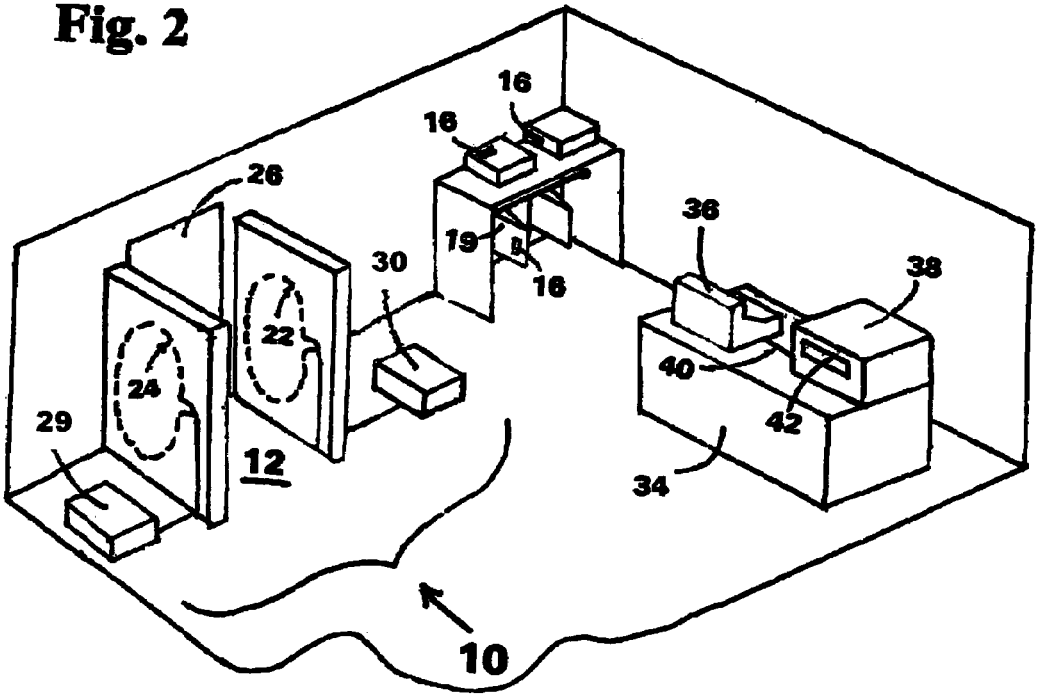
FIG. 2 is a diagrammatic illustration of a typical store installation of the system of FIG. 1.
Figure 4:
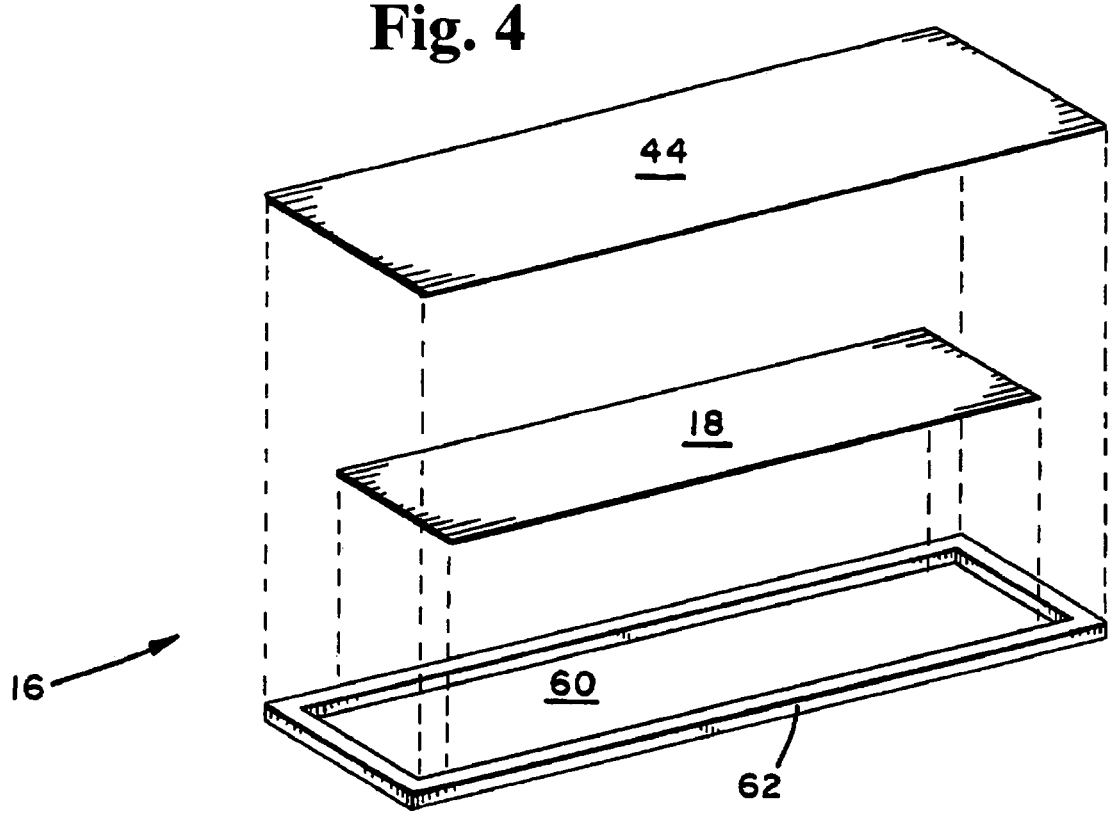
FIG. 4 is a perspective view showing components of a marker adapted for use in the system of FIG. 1.

Referring to FIGS. 1, 2 and 4 of the drawings, there is shown an embodiment of an article surveillance system 10 responsive to the presence of an article within an interrogation zone. The system 10 has means for defining an interrogation zone 12. An interrogating means 14, comprising a power source, transmitter, and an antenna such as coil 24, is provided for generating an oscillatory magnetic field of variable frequency within interrogation zone 12. Marker 16 is secured to an article 19 appointed for passage through the interrogation zone 12. The marker comprises at least one magnetomechanical element, such as elongated ductile strip 18 of magnetostrictive, ferromagnetic material adapted. When armed, the marker is adapted to vibrate in mechanical resonance at a natural resonant frequency of the element which is within the range of the incident magnetic field. A hard ferromagnetic element 44 disposed adjacent to the strip 18 of ferromagnetic material is adapted, upon being magnetized, to magnetically bias the strip 18 and thereby arm it to resonate.

Figure 3:
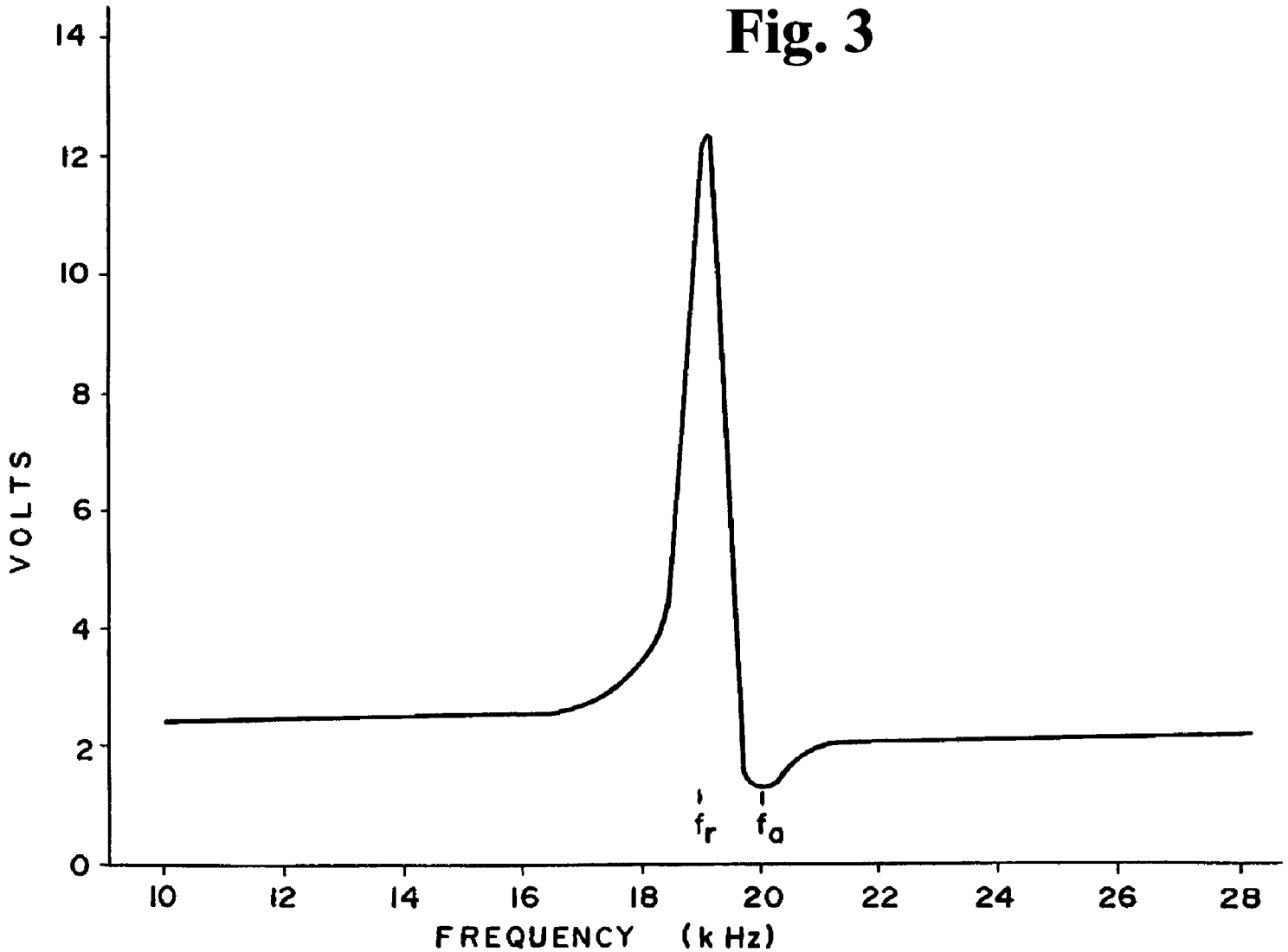
FIG. 3 is a graph showing the voltage induced by mechanical energy exchange of an article surveillance marker over a preselected frequency range.

The response of marker 16 to an ac electromagnetic field is manifest in various changes in its mechanical and magnetic properties, notably including changes in its effective magnetic permeability. An excitation frequency at or near the resonant and/or anti-resonant frequency results in a permeability markedly different from that seen for excitation at other frequencies. At resonance, the marker is urged to vibration by the external field, with a coupling that may be characterized by the marker's magnetomechanical coupling factor, "k," which is greater than 0 and given by the formula $k=[1-(f_r/f_a)^2]^{1/2}$, wherein $f_r$ and $f_a$ are the resonant and anti-resonant frequencies of the magnetostrictive element, respectively. FIG. 3 depicts schematically the behavior of effective permeability as a function of excitation frequency, with the resonant and anti-resonant frequencies shown as "$f_r$" and "$f_a$," respectively.

In system 10, interrogating means 14 comprises a source of ac current that is produced and fed to excitation coil 24 to create an ac electromagnetic field in interrogation zone 12. The coupling of this field into receiving coil 22 of detection means 20 is detectably altered by the presence of a marker 16 of the invention.

In the embodiment depicted by FIG. 2, coil units 22 and 24 of system 10 are disposed on opposing sides of a path or aisleway leading to the exit 26 of a store. A power source and transmitter that are part of interrogating means 14 are housed in power cabinet 29 and feed transmitting coil 24. Detecting means 20 further comprises a receiver that includes detection electronics and indicating means such as alarm 28 housed within a cabinet 30 located near exit 26. Signals incident on receiving coil 22 are fed to the receiver, which uses amplification and signal processing techniques to discriminate actual marker signals from extraneous electronic noise. Alarm 28 is optionally located elsewhere in a the store to provide notification that alerts security personnel to respond appropriately. Articles of merchandise 19, such as wearing apparel, appliances, books, and the like are displayed within the store. Each of the articles 19 has secured thereto a marker 16 constructed in accordance with an aspect of the present invention. As shown in FIG. 4, the marker 16 includes an elongated, ductile magnetostrictive ferromagnetic strip 18 that is normally in an activated mode. Placement of an article 19, bearing activated marker 16, between coil units 22 and 24 of interrogation zone 12 will cause an audible or visible alarm to be emitted from cabinet 30. Alternatively, a silent alarm is sent, for example to security personnel. In this manner, the system 10 prevents unauthorized removal of articles of merchandise 19 from the store.

Disposed on a checkout counter 34 near cash register 36 is a deactivator system 38. The latter can be electrically connected to cash register 36 by wire 40. Articles 19 that have been properly paid for are placed within an aperture 42 of deactivation system 38, whereupon a deactivating magnetic field is applied to marker 16. The desensitizing circuit applies to marker 16 a magnetic field that places the marker 16 in a deactivated mode, by either increasing or decreasing the magnetic bias field strength of the hard ferromagnetic material, by an amount sufficient to move the $f_r$ and $f_a$ outside of the frequency range of the applied field or to decrease the coupling factor k sufficiently to make it undetectable. The article 19 carrying the deactivated marker 16 may then be carried through interrogation zone 12 without triggering the alarm 28 in cabinet 30. Optionally, deactivation system 38 has detection circuitry adapted to determine if marker 16 has been properly deactivated. If not, the circuitry re-triggers the deactivation process.

The theft detection system circuitry with which the marker 16 is associated can be any system capable of (1) generating within an interrogation zone an alternating electromagnetic interrogating field of an appropriate frequency, (2) detecting changes in coupling at frequencies produced in the vicinity of the interrogation zone by the presence of the marker and (3) distinguishing the particular resonant and/or anti-resonant changes in coupling that provide the marker with a signal identifying characteristic from other variations in signals detected. Such systems typically include means for transmitting a varying electrical current from an oscillator and amplifier through conductive coils that form a frame antenna capable of developing a varying magnetic field. An example of such antenna arrangement is disclosed in French Pat. No. 763,681, published May 4, 1934, which description is incorporated herein by reference thereto. In some implementations the transmitting antenna arrangement comprises a plurality of coils that may be selectively interconnected and energized to provide a plurality of patterns of generated electromagnetic field that impinge on a marker during its passage through the interrogation zone. Some embodiments include plural receiving coils that also may be selectively interconnected. Each such connection is characterized by a different pattern of directional sensitivity to the electromagnetic fields emanated by excited markers. Sequential excitation of the target by differently oriented interrogating fields markedly increases the probability that a given marker will be favorably oriented within at least one of such field patterns, thus markedly decreasing the probability that a marker will pass through the interrogation zone without being activated by the interrogating field and consequently detected. In a system having but a single fixed antenna element, there is a slight probability that a marker in an orientation that is fortuitously unfavorable might escape detection. As a result, an EAS system employing plural antenna coils in at least one of the transmitting and receiving circuits is preferred.

In another embodiment the theft detection circuitry comprises an interrogating means capable of generating within an interrogation zone an alternating electromagnetic interrogating field provided as a preselected interrogating frequency, modulated as a series of pulses. Optionally, the interrogating frequency is chirped, that is to say, swept through a preselected range encompassing the resonant frequency of the marker, to ensure that the resonance is excited. The magnetomechanical element of the marker is urged to resonance during each pulse. After each pulse is completed, the energy stored in the magnetomechanically resonating element decays and as a result, the marker dipole field emanating from the marker decays or rings down correspondingly. The amplitude of the alternating field generally remains within an envelope that decays exponentially, affording the marker a signal-identifying characteristic that is detectable by a detecting means. The detection of this ring-down in synchrony with the activation of the marker by the interrogating field provides a preferred way of reliably discriminating the marker's response from other ambient electronic noise or the response of other nearby ferrous objects which are not resonantly excited. An indication means is operably associated with the detecting means and is activated in response to the detection of the signal-identifying characteristic by the detecting means. Preferably the indication means is a visible or audible alarm that signals and thereby alerts relevant persons to the presence of a tagged item, allowing timely response. Optionally, the indicating means further provides a printed record or a message transmitted to a computer system, video recorder, or other recording system to memorialize the detection of a marker of interest.

Referring now to FIG. 4 there is depicted generally a marker 16 of the invention having as a magnetomechanical element a strip 18 of amorphous metal ribbon. A bias magnet 44 is located in proximity to strip 18. A housing comprises a bottom section 62 having a cavity 60 to accommodate strip 18. The housing further comprises a cover (not shown) enclosing strip 18 and magnet 44.

The housing of the marker of the invention is preferably constructed of a rigid or semi-rigid plastic material. In other aspects of the invention parts or all of the housing may be integrally formed in packaging, e.g. that used for an article of commerce. Cavity 60 accommodates the magnetomechanical element in a manner that permits it to vibrate freely. A variety of manufacturing methods are suitable for producing the housing, including casting, molding by vacuum or injection techniques, and folding of sheet-form materials. The marker may further comprise additional cavities wherein the one or more bias magnets are disposed. The housing may be provided with apertures or other structures facilitating attachment of the marker to an appointed item. For example, a rivet, screw, lanyard, or adhesive may be used for the attachment. Alternatively, the marker may be disposed within an item of merchandise or similar article of commerce. In one embodiment, the packaging of the merchandise is provided with internal or eternal structures to accommodate the marker. The location of such structures may intentionally be made inconspicuous or not.

In an embodiment of the invention, the marker has a magnetomechanical element comprising at least one elongated strip of a magnetostrictive amorphous metal alloy. As used in this specification and the appended claims, the term "strip" includes forms such as wire, ribbon, and sheet. By elongated strip is meant an object with a geometrical form having a characteristic elongated length direction or orientation and a characteristic thin direction perpendicular to the length direction, with the dimension of the object along the elongated direction substantially greater than the dimension along the thin direction. Preferably the ratio of the dimensions is at least 100:1. For example, the thin direction in a cylindrical wire is along a diameter of the wire, while the long direction is along the cylindrical axis. A generally planar sheet or ribbon has a small thickness direction normal to the plane and a length direction in-plane. Preferably a rectangular sheet used in the marker of the invention has a long direction in-plane that is at least five times the in-plane width direction perpendicular thereto. Those skilled in the art will recognize that an elongated strip as defined herein possesses a low demagnetizing factor for magnetization along the elongated direction.

A variety of magnetostrictive amorphous metal alloy ribbons are useful in the construction of the marker of the present invention. Many amorphous metals combine high mechanical hardness and relatively low magnetic anisotropy and loss, leading to low internal friction, a high magnetomechanical coupling factor and magnetomechanical resonance with high Q. One amorphous metal suitable for the present marker consists essentially of an alloy having 40% Fe, 38% Ni, 4% Mo, and 18% B (atomic percentages) plus incidental impurities. Other amorphous metal alloys exhibiting desirable magnetomechanical behavior are also useful in the present marker. Optionally the magnetomechanical properties and response of the amorphous metal strip of the marker are enhanced by a heat treatment process. Such a process preferably is carried out in the presence of a magnetic field that promotes induction of magnetic anisotropy in the ribbon that is directed in a direction away from its elongated strip direction. Such an anisotropy may be directed either out of the ribbon plane or in a direction in plane but substantially transverse to the elongated direction.

In accordance with a preferred embodiment of the invention, marker 16 is composed of a magnetostrictive amorphous metal alloy. The marker is in the form of an elongated, ductile strip having a first component composed of a composition consisting essentially of the formula $M_aN_bT_cX_dY_eZ_f$, wherein M is at least one of iron and cobalt, N is nickel, T is at least one of chromium, molybdenum, vanadium, and niobirum, X is at least one of boron and phosphorous, Y is silicon, Z is carbon, "a"–"f" are in atom percent, the sum of a+b+c+d+e+f is 100, "a" ranges from about 35–85, "b" ranges from about 0–45, "c" ranges from about 0–7, "d" ranges from about 5–22, "e" ranges from about 0–15 and "f" ranges from about 0–2, and the sum of d+e+f ranges from about 15–25. Up to about 1 atom percent of impurities may also be present.

The marker is further provided with a bias means that provides a magnetic field to bias the magnetomechanical element and thereby arm it to resonate. The bias means may comprise one or more magnetized elements composed of permanent (hard) magnetic material or semi-hard magnetic material. Preferably magnetic material of either type has a magnetic coercivity sufficient to prevent the material from becoming demagnetized due to inadvertent exposure to other magnetic fields. A wide variety of magnetic materials are suitable. High anisotropy, high coercivity materials, such as ferrites and rare-earth magnets, may be provided as magnets having a short aspect ratio, i.e., a low ratio of the dimensions along the magnetization direction and in a perpendicular direction. Other materials, such as Arnochrome, vicalloy, and hard steels, are advantageously employed as thin strips, preferably aligned generally parallel to elongated magnetomechanical amorphous strips. In some implementations the bias means may comprise magnetized magnetic powder, such as barium ferrite, which may be dispersed within a polymeric matrix comprising part or all of the marker housing. Other forms by which the bias means may be incorporated in or on the housing will be apparent to persons skilled in the art. In still other implementations the bias field is provided externally by a dc magnetic field from a permanent magnet or an electromagnet.

It has been found that a strip 18 of material having the formula specified above is particularly adapted to resonate mechanically at a preselected frequency of an incident magnetic field. While we do not wish to be bound by any theory, it is believed that, in markers of the aforesaid composition, direct magnetic coupling between an ac magnetic field and the marker 16 occurs by means of the following mechanism.

When a ferromagnetic material such as an amorphous metal ribbon is in a magnetic field (H), the ribbon's magnetic domains are caused to grow and/or rotate. This domain movement allows magnetic energy to be stored, in addition to a small amount of energy which is lost as heat. When the field is removed, the domains return to their original orientation releasing the stored magnetic energy, again minus a small amount of energy lost as heat. Amorphous metals have high efficiency in this mode of energy storage. Since amorphous metals have no grain boundaries and have high resistivities, their energy losses are extraordinarily low.

When the ferromagnetic ribbon is magnetostrictive, an additional mode of energy storage is also possible. In the presence of a magnetic field, a magnetostrictive amorphous metal ribbon will have energy stored magnetically as described above but will also have energy stored mechanically via magnetostriction. This mechanical energy per unit volume stored can be quantified as $U_e=(1/2)$ TS where T and S are the stress and strain on the ribbon. This additional mode of energy storage may be viewed as an increase in the effective magnetic permeability of the ribbon.

When an ac magnetic field and a dc field are introduced on the magnetostrictive ribbon (such as can be generated by and ac and dc electric currents in a solenoid), energy is alternately stored and released with the frequency of the ac field. The magnetostrictive energy storage and release are maximal at the material's mechanical resonance frequency and minimal at its anti-resonance. This energy storage and release induces a voltage in a pickup coil via flux density changes in the ribbon. The flux density change may also be viewed as an increase in effective magnetic permeability at the resonant frequency and a decrease at anti-resonance, thus, in effect, increasing or decreasing, respectively, the magnetic coupling between the driving solenoid and a second pickup solenoid. The voltage induced by the purely magnetic energy exchange is linear with frequency and the change in voltage with frequency is small over a limited frequency range. The voltage induced by the mechanical energy exchange is also linear with frequency except near mechanical resonance.

The transfer of magnetic and mechanical energy described above is called magnetomechanical coupling (MMC), and can be seen in all magnetostrictive materials. The efficiency of this energy transfer is proportional to the square of the magnetomechanical coupling factor (k), and is defined as the ratio of mechanical to magnetic energy. The larger the k factor, the greater the voltage difference between resonant peak and anti-resonant valley. Also, the larger the k, the larger the difference in frequency between resonance and anti-resonance. Therefore, a large k facilitates the observation of the MMC phenomena.

Coupling factors are influenced in a given amorphous metal by the level of bias field present, the level of internal stress (or structural anisotropy) present and by the level and direction of any magnetic anisotropy. Annealing an amorphous metal relieves internal stresses, thus enhancing k. The structural anisotropy is small due to the ribbon's amorphous nature, also enhancing k. Annealing in a properly oriented magnetic field can also induce magnetic anisotropy in the ribbon along the field direction, further enhancing coupling factors. Domain movement can be maximized when the ribbon has a magnetic anisotropy which is substantially perpendicular to the interrogating field. Because of demagnetizing field effects, it is generally practical to interrogate the ribbon only along its length (this being the longest dimension). Therefore, it is preferred that the induced magnetic anisotropy be in a direction substantially perpendicular to the long dimension of the ribbon. More preferably, the anisotropy is in the ribbon plane and transverse to its length.

Figure 5:
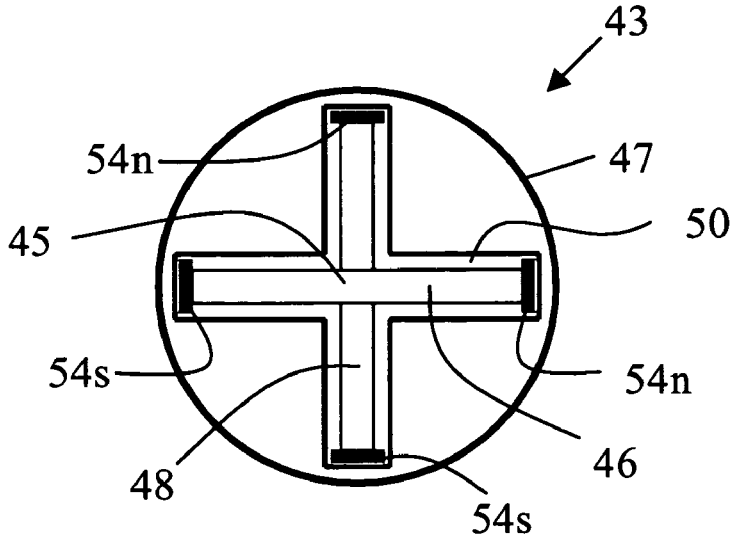
FIG. 5 depicts a partial top view of a marker of the invention having two magnetomechanically resonant, amorphous metal strips.
Figure 6:
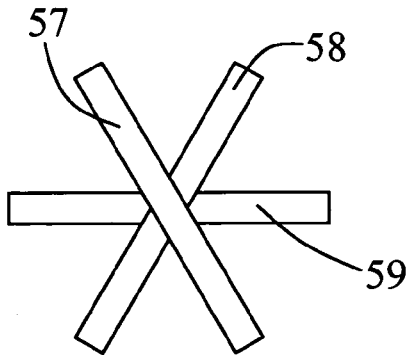
FIG. 6 is a top view depicting part of a marker of the invention employing three elongated amorphous metal strips oriented equi-angularly.

One suitable marker for the practice of the invention has a magnetomechanical element comprising a plurality of elongated strips, preferably composed of amorphous metal, disposed in a non-parallel orientation, i.e., a configuration in which the respective elongated directions of the strips are not parallel. In this aspect it is preferred that the strips are disposed in a stack with their centers generally coincident. FIGS. 5 and 6 depict embodiments of the marker having strips disposed equi-angularly, i.e., with two perpendicularly oriented strips and with three strips at 120° intervals, respectively.

The marker 43 depicted by FIG. 5 is housed in a generally cylindrical, thin, disk-shaped carrier 47. A magnetomechanical element 45 comprises first elongated strip 46 and second elongated strip 48, both being composed of a ribbon of amorphous metal alloy. The ribbons are disposed in cavity 50 of housing 47 with their elongated directions substantially perpendicular, their centers substantially coincident, and their planes substantially parallel. Cavity 50 is sized and shaped to accommodate ribbons 46, 48 and allow them to vibrate freely. A bias means whereby magnetomechanical element 45 is armed to resonate is provided by magnets **54*n* and 54*s*, each of which has a north pole and a south pole. A magnet 54*n* and a magnet 54*s* are disposed at opposite ends of ribbon 46. Magnet 54*n* has its north pole proximate one end of first ribbon 46, while magnet 54*s* has its south pole proximate the other end of first ribbon 46. A magnet 54*n* and a magnet 54*s* are similarly disposed at opposite ends of second ribbon 48. A cylindrical cover (not shown) having the form of a disk with a diameter matching that of carrier 47** and affixed thereon seals the marker and the components therein. The attachment of the cover may be accomplished by adhesive, welding, a mechanical snap fit, a fastener such as a rivet or screw, or other means apparent to one skilled in the art.

FIG. 6 depicts a configuration for use in a marker of the invention in which three substantially similar, magnetostrictive amorphous metal strips 57, 58, 59 are oriented equiangularly with their centers substantially coincident. The planes of the strips are substantially parallel. The ribbons are disposed in a suitable housing (not shown) similar to that depicted by FIG. 5, but having three cavities oriented at equally spaced angles, instead of the two cavities seen in FIG. 5. One suitable bias means is similar to that used with the embodiment of FIG. 5, comprising magnets of opposite polarity at the respective ends of each strip.

A number of advantages are conveyed by the use of markers having plural strips. The strength of the dipole field radiated by the marker in resonance increases in rough proportion to the volume of resonating material. The signal available for detection is in general increased by use of markers having more magnetomechanical material, thereby enhancing the reliability of the detection system in identifying the presence of a tagged item. In addition, the increased signal significantly improves detection accuracy, increasing the efficacy of the EAS system as a deterrent to would-be thieves or shoplifters. Further, a marker of the present invention with strips having more than one orientation is readily excited by interrogating fields that range widely in vector direction. Since at least one of the directions in which the marker is most sensitive is inevitably oriented sufficiently close to the direction of the interrogating field that the marker encounters, it is even less likely that the marker would pass through an interrogation zone without being detected. On the other hand, markers comprising a single elongated strip are most sensitive to excitation by an interrogating field having a strong vector component along a single preferred marker orientation, in most cases the elongated direction of the strip. Even though the interrogating field may vary in both magnitude and direction as a function of position within the interrogation zone, a marker fortuitously oriented in an unfavorable direction has a small chance of never being excited while traversing the interrogation zone. While this possibility is remote, a marker sensitive to interrogation fields in more than one orientation by virtue of having differently oriented elements is nonetheless preferred for use in the present system to provide enhanced reliability and detectability.

Figure 7:
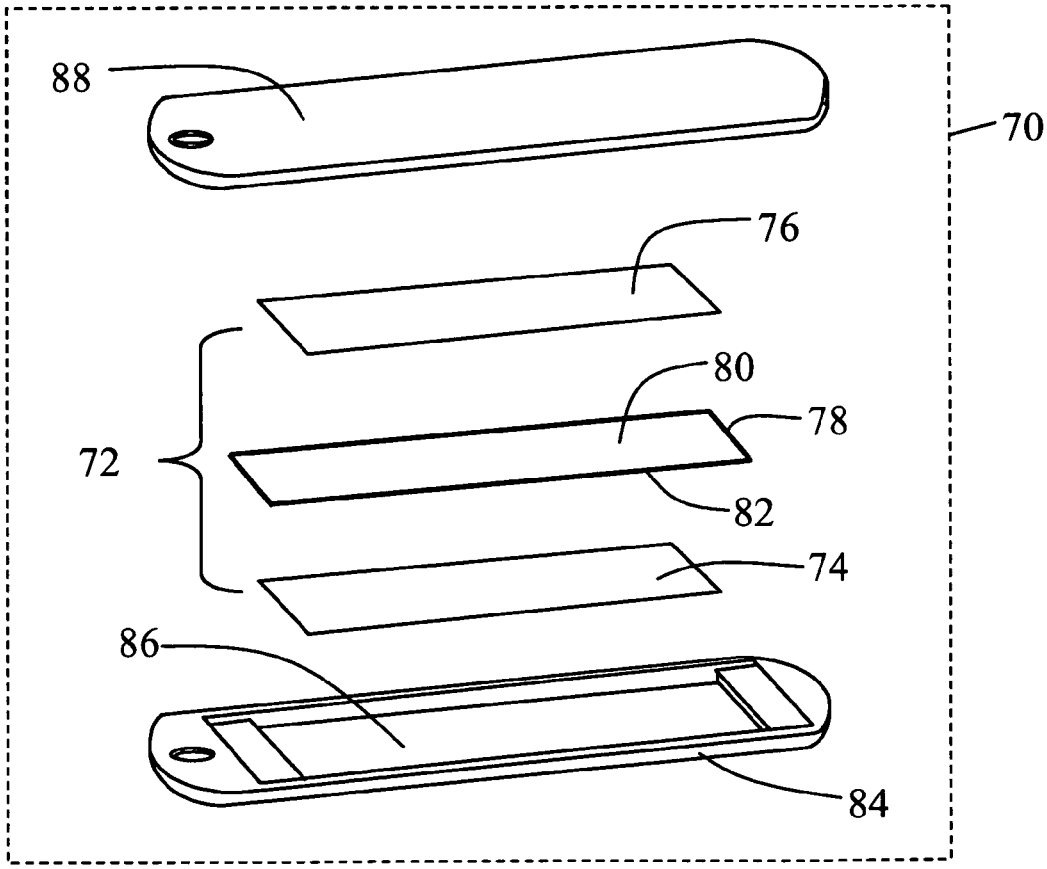
FIG. 7 is an expanded, perspective view depicting a marker of the invention having two magnetomechanically resonant strips surrounding a bias magnet strip.

In another aspect of the invention depicted by FIG. 7, the magnetomechanical element 72 of marker 70 comprises a first elongated strip 74 and a second elongated strip 76, preferably composed of amorphous metal. The marker further comprises a bias magnet disposed between the alloy strips. Preferably the bias magnet takes the form of a strip 78 having a top side 80 and a bottom side 82, as depicted by FIG. 7. The strips are oriented with their length directions substantially parallel. In addition, the planes of the strips are substantially parallel. The housing comprises a bottom section 84 having a cavity 86 and a top section 88, in which the magnetomechanical strips are free to vibrate. In this configuration, the symmetrical disposition of the magnetomechanical strips advantageously results in application of a biasing magnetic field that is of substantially equal magnitude for each. As a result, the resonant frequencies of the strips are substantially equal, and the resonances of the strips are thus easily excited in concert by a common interrogating field. Therefore, such a marker, having a greater volume of resonating material than a prior art marker with but a single elongated strip, will in most cases deliver an enhanced signal strength.

It is further preferred that the magnetomechanical element of the present marker resonate at a high frequency. Conventional magnetomechanical article surveillance systems employ markers resonant at frequencies of 50 to 60 kHz. Such a marker normally employs a strip of amorphous metal about 4 cm long. Significant advantages attend systems using markers resonant at higher frequencies and comprising one or more elongated strips of amorphous metal. Many commonly encountered sources of electronic noise have a 1/f frequency spectrum, so less noise is present at higher frequencies. More importantly, the resonant frequency of an elongated strip is approximately inversely proportional to the strip's length. Increasing the chosen resonant frequency thus allows use of shorter strips in constructing the marker for the system of the invention. As a result, the entire marker may be made advantageously smaller. Beneficially the marker of the invention uses a smaller amount of the relatively expensive amorphous metal strip and bias magnetic material. More importantly, items of merchandise too small to accommodate existing markers may be tagged using the present marker. In addition, markers of decreased size are far more easily made inconspicuous or concealed in packaging. Advantageously, markers of the invention that are resonant at 120 kHz or more are about half the length of conventional markers or less, yet provide adequate signal for detection. A single detection system sensitive to the present marker is thus readily adapted for identifying a much wider variety of items than existing systems.

A preferred marker of the invention is resonant at a frequency ranging from about 70 to 300 kHz. The markers disclosed by prior art workers typically use a housing slightly longer than the length of the magnetomechanically resonant element which is often about 4 cm long. This length is constrained principally by the length of an amorphous strip that exhibits a magnetomechanical resonance at an operating frequency preselected in the range of 50 to 60 kHz. The amorphous metal ribbon used conventionally is typically between 4 and 12 mm wide. The higher resonant frequency of the present marker allows it to be correspondingly shorter, thereby allowing tagging of items heretofore not amenable to such protection. Advantageously, an increase to 120 kHz allows a marker to be shortened to about 2 cm, or less than 1 inch. However, the shortened marker also needs to use correspondingly narrower ribbon to maintain a similar demagnetizing factor and definition of its characteristic modes of resonant vibration. Preferably, the marker of the invention comprises a rectangular ribbon having an aspect ratio, i.e. a ratio of length to width, of at least about 4:1. More preferably the aspect ratio is at least 8:1. It is preferred that at least the same dimensional ratios be maintained for elongated strips of other forms, e.g. wire. Without being bound to any particular theory, it is believed that maintaining the same aspect ratio of length to width for rectangular ribbon of constant thickness results in an amorphous strip having a volume that decreases approximately with the square of the operating frequency, with a concomitant loss of signal strength as discussed hereinabove in greater detail. This decrease, along with the need for tighter dimensional control in marker manufacture and the generally faster ring-down in structures resonating at higher frequencies, makes it preferable for the resonant frequency not to exceed about 300 kHz and for the marker to comprise plural strips to increase the radiated resonant signal. An excessively high resonant frequency also impinges on other sources of electromagnetic noise, such as the 455 kHz intermediate frequency of conventional superheterodyne AM broadcast receivers. A 300 kHz marker will have a length about one fifth that of a conventional marker, allowing a very wide range of implements to be tagged. More preferably, the resonant frequency ranges from about 110 to 250 kHz, permitting the marker to be significantly shorter than conventional markers, yet have sufficient magnetic material for detectability and consistent manufacture. Still more preferably, the marker has a resonant frequency ranging from about 120 to 200 kHz.

In many cases, the plastic housing used for the marker of the present invention provides some structure that allows the marker to be attached to an item appointed for protection. The term "marker" as used herein thus refers generically to the combination of the magnetomechanically active element, any required bias means, and a housing that may provide structures needed for mounting or affixing the marker to an article. In addition, it will be understood that a marker may further include one or more active elements responsive to article surveillance systems of different types.

Having thus described the invention in rather full detail, it will be understood that such detail need not be strictly adhered to but that various changes and modifications may suggest themselves to one skilled in the art, all falling within the scope of the invention as defined by the subjoined claims.

What is claimed is:

1. An electronic article surveillance system, comprising:

a) a marker that exhibits magnetomechanical resonance at a resonant frequency in response to the incidence thereon of an alternating electromagnetic interrogating field and radiates a marker dipole field in response to incidence of said interrogating field, said marker comprising:

i) at least one magnetomechanical element comprising a plurality of elongated strips composed of magnetostrictive amorphous metal alloy and providing said mechanical resonance, said strips having centers that are substantially coincident;

ii) a bias means for magnetically biasing and thereby arming said magnetomechanical element to resonate; and iii) a housing enclosing said magnetomechanical element and said bias means, wherein said magnetomechanical element is free to mechanically vibrate in said housing at said resonant frequency, said resonant frequency being substantially equal to said preselected interrogating frequency and ranging from about 70 to 300 kHz, whereby said marker is provided with a signal-identifying characteristic of a ring-down of said dipole field;

b) an interrogating means for generating said electromagnetic interrogating field having a preselected interrogating frequency;

c) a detecting means for detecting said signal-identifying characteristic; and d) an indication means activated by said detecting means in response to the detection of said signal-identifying characteristic.

2. A system as recited by claim 1, wherein said preselected interrogating frequency is swept through a frequency range encompassing the resonant frequency of said marker.

3. A system as recited by claim 1, wherein said preselected interrogating frequency is modulated as a series of pulses.

4. A system as recited by claim 1, wherein the orientation of said strips is non-parallel.

5. A system as recited by claim 1, wherein: said bias means comprises a bias magnet having a top side and a bottom side; said magnetomechanical element comprises a first elongated strip and a second elongated strip, each of said strips being composed of magnetostrictive amorphous metal alloy; said first elongated strip is disposed on said top side and said second elongated strip is disposed on said bottom side of said bias magnet; and the planes of said first and second elongated strips are substantially parallel.

6. A system as recited by claim 5, wherein said first and second elongated strips are in substantially parallel orientation.

7. A system as recited by claim 1, wherein each of said strips has substantially the same resonant frequency.

8. A system as recited by claim 1, wherein said resonance frequency ranges from about 110 to 250 kHz.

9. A system as recited by claim 8, wherein said resonance frequency ranges from about 120 kHz to 200 kHz.

10. For use in an electronic article surveillance system, a magnetomechanical marker comprising:

a) a magnetomechanical element comprising a plurality of elongated strips composed of magnetostrictive amorphous metal alloy, said strips having centers that are substantially coincident;

b) a housing having at least one cavity sized and shaped to accommodate said strips, and said strips being disposed in said cavity and able to mechanically vibrate freely therewithin; and c) a bias means for magnetically biasing said magnetomechanical element, said magnetomechanical element being armed to resonate at a resonant frequency in the presence of an interrogating electromagnetic field, said resonance providing said marker with a signal-identifying characteristic, and said resonant frequency ranging from about 70 to 300 kHz.

11. A magnetomechanical marker as recited by claim 10, wherein said resonant frequency ranges from about 110 to 250 kHz.

12. A magnetomechanical marker as recited by claim 11, wherein said resonant frequency ranges from about 120 to 200 kHz.

13. A marker as recited by claim 10, wherein said strips are disposed in said cavity with a non-parallel orientaion.

14. A magnetomechanical marker as recited by claim 10, wherein said marker radiates a marker dipole field in response to incidence of said interrogating field, and said signal-identifying characteristic is a ring-down of said dipole field.

15. For use in an electronic article surveillance system, a magnetomechanical marker comprising:

a) a magnetomechanical element comprising a plurality of elongated strips composed of magnetostrictive amorphous metal alloy;

b) a housing having at least one cavity sized and shaped to accommodate said strips, and said strips being disposed in said cavity with a non-parallel orientation and able to mechanically vibrate freely therewithin; and c) a bias means for magnetically biasing said magnetomechanical element, whereby said magnetomechanical element is armed to resonate at a resonant frequency in the presence of an interrogating electromagnetic field, said resonance providing said marker with a signal-identifying characteristic.

16. A magnetomechanical marker as recited by claim 15, wherein said resonant frequency ranges from about 70 to 300 kHz.

17. A magnetomechanical marker as recited by claim 16, wherein said resonant frequency ranges from about 110 to 250 kHz.

18. A magnetomechanical marker as recited by claim 17, wherein said resonant frequency ranges from about 120 to 200 kHz.

19. A magnetomechanical marker as recited by claim 15, wherein said marker radiates a marker dipole field in response to incidence of said interrogating field, and said signal-identifying characteristic is a ring-down of said dipole field.

20. For use in an electronic article surveillance system, a magnetomechanical marker comprising:

a) a magnetomechanical element comprising a first and a second elongated strip, each strip being composed of magnetostrictive amorphous metal alloy;

b) a housing having at least one cavity sized and shaped to accommodate said strips;

c) a bias magnet magnetically biasing said magnetomechanical element, said bias magnet having a top side and a bottom side, said magnetomechanical element being armed to resonate at a resonant frequency in the presence of an interrogating electromagnetic field, said resonance providing said marker with a signal-identifying characteristic;

d) said first elongated strip being disposed on said top side of said bias magnet and said second elongated strip being disposed on said bottom side of said bias magnet.

21. A magnetomechanical marker as recited by claim 20, wherein said resonant frequency ranges from about 70 to 300 kHz.

22. A magnetomechanical marker as recited by claim 21, wherein said resonant frequency ranges from about 110 to 250 kHz.

23. A magnetomechanical marker as recited by claim 22, wherein said resonant frequency ranges from about 120 to 200 kHz.

24. A magnetomechanical marker as recited by claim 20, wherein said marker radiates a marker dipole field in response to incidence of said interrogating field, and said signal-identifying characteristic is a ring-down of said dipole field.

* * * * *